United States Patent [19]

Bacca

[11] 4,125,960

[45] Nov. 21, 1978

[54] TOY GLIDER

[76] Inventor: Charles R. Bacca, 2250 Williamsburg-Batavia Pk., Batavia, Ohio 45103

[21] Appl. No.: 801,520

[22] Filed: May 31, 1977

[51] Int. Cl.[2] ..... A63H 27/14

[52] U.S. Cl. ..... 46/79; 46/81

[58] Field of Search ..... 46/79–81

[56] References Cited

U.S. PATENT DOCUMENTS

| | | | |
|---|---|---|---|
| 2,876,585 | 3/1959 | Zaic | 46/79 |
| 3,778,926 | 12/1973 | Gladych | 46/79 |
| 3,803,752 | 4/1974 | Vanni | 46/81 |
| 3,943,657 | 3/1976 | Leckie | 46/80 |

*Primary Examiner*—Louis G. Mancene
*Assistant Examiner*—Robert F. Cutting
*Attorney, Agent, or Firm*—Walter S. Murray

[57] ABSTRACT

A toy glider construction adjustable to form a split Delta wing design to be propelled upwardly into the atmosphere by a sling or catapult and provided with an airflow sensor responsive to glider deceleration which atuomatically converts the glider wings from propelled conditions to soaring flight positions.

7 Claims, 6 Drawing Figures

10
37
36
35
13
43
42
39
22
44
11
28
26
3
3
20
19
41
12
21
24
23
39
41
17
15
20
19
28
34
32
12
30
31
29
33

TOY GLIDER

The present invention relates to an amusement device such as a toy glider adapted to be propelled upwardly by means of a sling or catapult for subsequent soaring flight through the atmosphere.

It is an object of the invention to provide a glider construction which secures optimum launching and altitude attaining conditions for the glider and which is programmed to obtain speed flying and/or long glide patterns subsequent to it's attainment of the launched altitude.

Another object of the invention is to provide an improved means that is responsive to glider deceleration which automatically converts the glider controls from propelled altitude condition to a soaring flight condition.

A further object of the invention is to provide a toy glider capable of obtaining a vertically launched altitude of well over 50 feet and to then automatically assume a soaring condition for free flight averaging 200 feet.

Still another object is to provide a toy glider construction having a free floating front wing member that is self conpensating to strong wind currents to thereby attain improved soaring patterns for the glider.

Other objects and advantages of the invention will become apparent from the following specification taken in conjunction with the accompanying drawings, wherein.

Figures 2, 4, 5, 6:
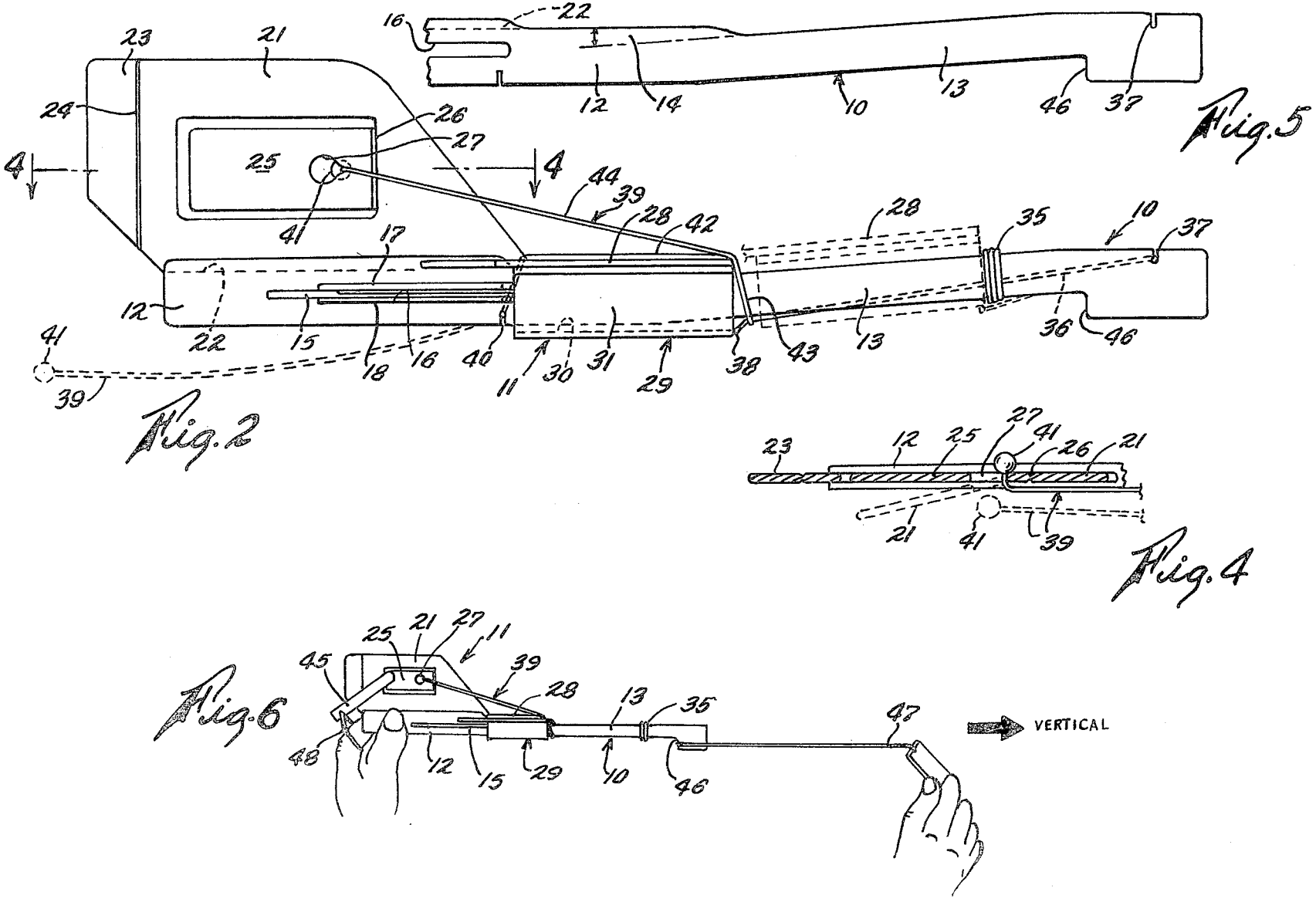
FIG. 2 is a side elevational view of the glider depicted in FIG. 1.
FIG. 4 is a section taken on line 4—4 of FIG. 2.
FIG. 5 is a fragmental, side elevational view of a fuselage member for the glider shown in FIGS. 1 and 2 of the drawings.
FIG. 6 is a side elevational view depicting a means for launching and propelling the toy glider of this invention into the atmosphere.

With reference to the drawings my toy glider construction comprises an elongated fuselage member 10, best shown in FIG. 5 of the drawings, having a longitudinal axis parallel to the propelled direction of flight of the glider 11, said fuselage member being divided into a tail or rear portion 12 and a forward portion 13; the latter portion being inclined upwardly and forwardly relative to the rear portion 12 at an angle 14 of approximately 3 degrees. The tail section of the glider comprises a large, rear wing member 15 (FIG. 1) that extends through a slot 16 formed in the fuselage member, the center of the wing being fixed in the slot by upper and lower filler strips 17 and 18, respectively, (FIG.2) which also serve to strengthen the wing member. This wing member 15 may have a swept back and tapered leading edge and may be provided with aileron tabs 19 formed by making hinge lines 20 in the body of the wing member. The tail section also has an upstanding fin member 21 (FIG. 2) which has a lower edge portion secured in a longitudinal slot 22 formed in the upper edge of the rear portion 12 of the fuselage member and may be provided with the usual rudder 23, if desired, by making a hinge line 24 in the fin body. An airflow sensor flap 25 is preferably formed in the central part of the fin member 21 by stamping out a narrow U-shaped strip from the body of the flap whereby the forward, upstanding edge portion of the sensor flap is hinged at 26 to the fin member and the flap being normally disposed within the confines of the fin body. A forwardly extending tear drop-shaped opening 27 is formed in the fin body for purposes to be fully described hereafter.

Figures 1, 3:
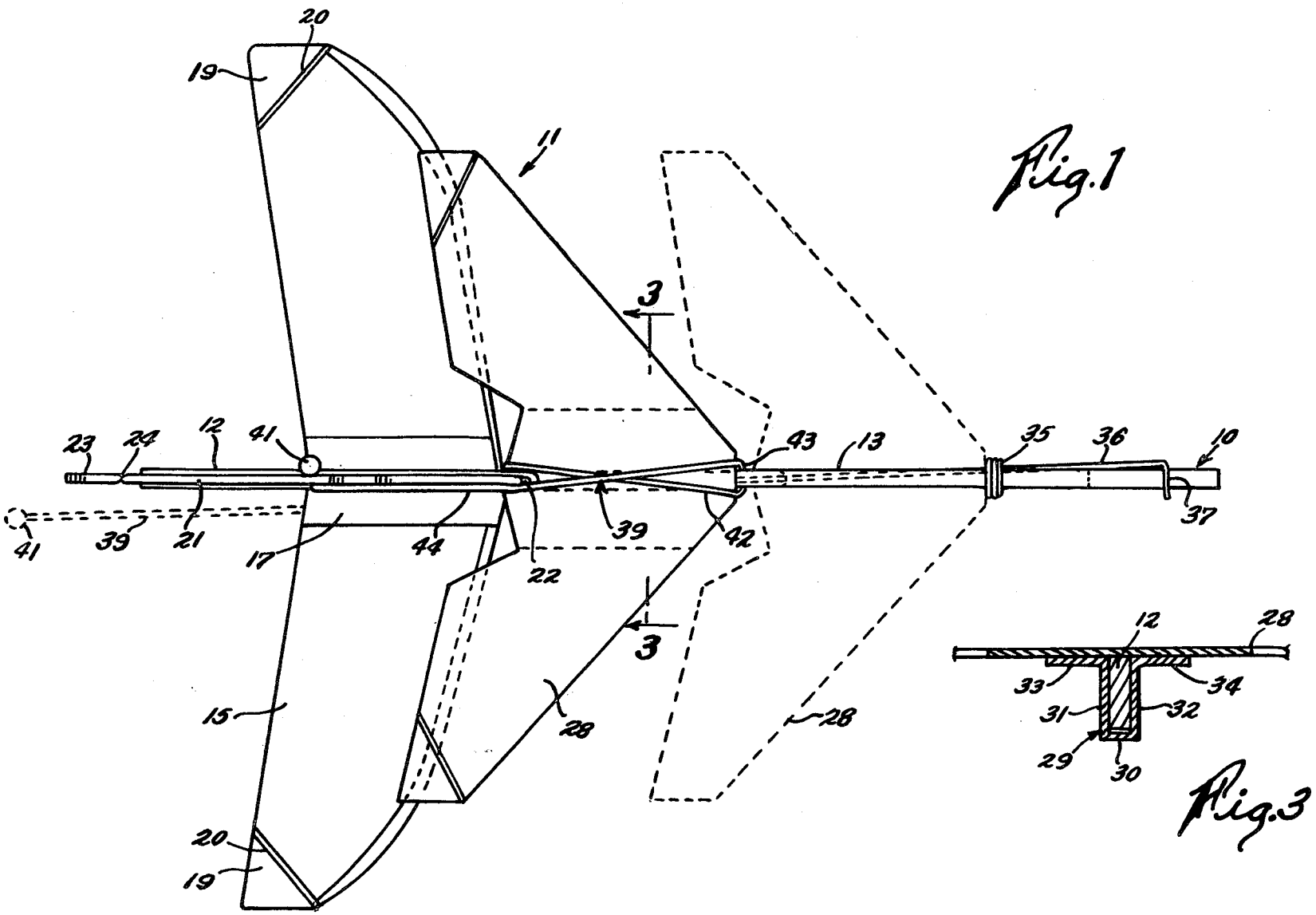
FIG. 1 is a top plan view of a toy glider with its parts shown in launched and altitude attaining conditions, the dotted lines indicating the soaaring positions of the glider parts.
FIG. 3 is a section taken on line 3—3 of FIG. 1.

With particular reference to FIG. 2 of the drawings, the toy glider has a small, forward wing member 28 mounted for longitudinal sliding movement upon the fuselage member 10 between a glider propelled position depicted in full lines in FIGS. 1 and 2 and a glider soaring position shown in dotted lines in said Figures. The means slidably mounting the small wing member 28 on the fuselage comprises a U-shaped bracket 29 loosely surrounding the fuselage member 10 (FIG. 3) and having a bottom wall 30 spaced from the bottom edge of the fuselage member, and opposed upstanding side walls 31 and 32 each provided with an oppositely projecting ear 33 and 34, respectively, that are fastened to the central underside face of the small wing member 28.

A stop 35, preferably in the form of a stretched, multilooped rubber band, is longitudinally adjustable for preselected soaring positions on the forward portion 13 of the fuselage member. A contractile cord 36, such as a rubber band, is anchored at its forward end in a slit 37 in the top forward portion of the fuselage member and having its rear end secured at 38 (FIG. 2) to the bottom leading end portion of the bracket 29. The contractile cord 36 continuously urges the small wing member 28 into soaring position toward and against the stop 35.

For the purpose of providing optimum propelled flight for the toy glider the small wing member 28 is tethered adjacent the large wing member 15 by a contractile cord 39, preferably made of elastic fabric. The cord 39 is anchored at one end in a slit 40 in the bottom edge of the fuselage member, the free end of the cord having an enlargement in the form of a ball 41 fastened thereto. The ball has a diameter less than the diameter of the large part of the teardrop-shaped opening 27 (FIG. 4) in the sensor flap 25 but greater than the restricted forward portion of said opening whereby the ball 41 and the hole 27 form the separable elements of a detachable means connecting the tether 39 to the sensor flap 25.

The launching steps for the toy glider construction described heretofore are initiated by placing the glider parts in the propelling condition shown in full lines in FIGS. 1 and 2 of the drawings, which procedure includes sliding the small wing member 28 rearwardly against the bias of the cord 36 to form a split Delta wing design. While the small wing member 28 is in its propelled condition upon the rear portion 12 of the fuselage member, parallel with and adjacent to the large wing member 15 with its trailing edge portion preferably overlying the leading edge of the large wing member, the tether cord 39 is manually stretched straight up from its anchoring slit 40 in the fuselage member 10 and around the rear edge of the small wing member, pulled diagonally across the top surface of said small wing member 28 at 42 (FIG. 1), looped down and around the fuselage member at 43 (FIG. 2) and then turned around the leading edge of the samll wing member, the end portion 44 of the cord 39 being stretched rearwardly beside the fin member 21 and the ball 41 inserted through the opening 27 in the sensor flap 25. Thus the cord 39 forms an elastic tether connected to the small wing member which firmly holds said member on the fuselage portion 12 for launching procedures. It is also to be noted that the launching tension in the cord 39 is greater than the tension in the cord 36 whereby the small wing member will be held adjacent the large wing member 15. A suitable wing clip 45 (FIG. 6) is slid over the opposed surfaces of the sensor flap and the fin to hold the sensor flap within the confines of the fin body during launching procedure of the glider.

The forward end of the fuselage is provided with a shoulder 46 adapted to be engaged by a launching device such as the elastic sling 47 shown in FIG. 6 of the drawings. Now with the toy glider and sling manually held in the illustrated position, a flexible loop 48 connects the clip 45 to a finger of one hand, the glider and sling are directed vertically, the sling stretched and then released to propel the glider into the atmosphere. As the glider is released the clip 45 will be instantly pulled away leaving the sensor flap 25 to remain within the confines of the body of the fin 21 due to the high velocity airflow around it as the glider attains altitude.

As the glider reaches maximum propelled altitude preparatory to entering the soaring phase, decelaration of the glider reduces airflow around the sensor flap 25 thus permitting the cord 39 to swing the sensor flap outwardly around its hinge 26 (FIG. 4) to release the ball 41 from the flap opening 27. This release of the separable fastener means disengages the cord 39 from the small wing member 28 allowing the contractile cord 36 to pull the said small wing member forwardly against the stop 35 thus automatically placing the glider parts in soaring positions.

The angle of glide is determined by the position of the stop 35 which controls the relative angle between the two wing members, the loose connection between the small wing and the fuselage permitting the samll wing to be free working and self compensating for strong wind currents.

What is claimed is:

1. A toy glider adapted to be propelled upwardly for subsequent soaring flight through the atmosphere, comprising:

an elongated fuselage member having a longitudinal axis parallel to the propelled direction of flight of the glider, a tail section including a large wing member and a fin member both mounted on the fuselage, an airflow sensor flap hinged to the fin member, a stop on the forward part of the fuselage member, a small wing member, means mounting the small wing member for longitudinal sliding movement on the fuselage member between a glider propelled position adjacent the large wing member and a glider soaring position against the stop, biasing means continuously urging the small wing member toward its soaring position, an elastic tether connected to the small wing member and adapted in stretched condition to overcome the biasing means to hold the small wing member in glider launched position adjacent the large wing member, and detachable means connecting the free end of the tether to the airflow sensor flap, whereby, upon deceleration of the propelled glider, reduced airflow around the sensor flap allows said flap to swing around its hinge and sever the detachable means causing the small wing member to move forwardly under the influence of the biasing means into its glider soaring position.

2. A toy glider as set forth in claim 1 wherein the fuselage member has a rear portion and a foward portion inclined upwardly and forwardly with respect to said rear portion, the tail section is mounted on the rear portion, the small wing member is slidably mounted for movement from upon the rear portion and along the forward portion of the fuselage member, and the stop is longitudinally adjustable on the forward portion for securing preselected soaring positions for the small wing member on the forward portion of said fuselage member.

3. A toy glider as set forth in claim 1 wherein a detachable clip is applied between the fin member and the sensor flap during launching of the glider.

4. A toy glider as set forth in claim 1 wherein the means mounting the small wing member for longitudinal sliding movement on the fuselage member has a loose, upwardly biased fit on the fuselage member permitting adjustment of the soaring flight angle of the small wing member responsive to variable wind conditions in the atmosphere.

5. A toy glider as set forth in claim 1 wherein the detachable means is an enlargement connected to the free end of the tether, and a forwardly facing teardrop-shaped opening is formed in the sensor flap to normally receive the enlargement.

6. A toy glider as set forth in claim 5 wherein the tether is an elastic cord secured at one end to the fuselage member and normally stretched around the forward edge of the small wing member and pulled under tension into engagement of its enlargement with the teardrop-shaped opening in the sensor flap.

7. A toy glider as set forth in claim 5 wherein the tether is an elastic cord anchored at one end to the underside of the fuselage member and normally stretched upwardly around the rear edge of the small wing member then diagnonally across the top of said small wing member, looped down and around the fuselage member, stretched around the forward edge of said small wing member, and the end portion of the cord being stretched rearwardly beside the fin member.

* * * * *